US009062466B2

(12) United States Patent
Glynos

(10) Patent No.: US 9,062,466 B2
(45) Date of Patent: Jun. 23, 2015

(54) UNIVERSAL LEVELING DEVICE

(71) Applicant: Peter N. Glynos, Warren, NJ (US)

(72) Inventor: Peter N. Glynos, Warren, NJ (US)

( * ) Notice: Subject to any disclaimer, the term of this patent is extended or adjusted under 35 U.S.C. 154(b) by 12 days.

(21) Appl. No.: 13/998,592

(22) Filed: Nov. 15, 2013

(65) Prior Publication Data

US 2015/0135609 A1 May 21, 2015

(51) Int. Cl.
*E02D 27/00* (2006.01)
*E04G 21/18* (2006.01)
*E04F 21/18* (2006.01)

(52) U.S. Cl.
CPC ..... *E04G 21/1841* (2013.01); *E04G 21/185* (2013.01); *E04F 21/1877* (2013.01)

(58) Field of Classification Search
CPC ..... E02D 27/42; E02D 27/50; E04F 21/1877
USPC ..... 52/126.3, 126.1, 292, 293.3, 293.1, 52/293.2; 248/346.01, 346.05, 346.03, 248/346.06, 346.5, 180.1; 33/333, 334
See application file for complete search history.

(56) References Cited

U.S. PATENT DOCUMENTS 155,635 A * 10/1874 Brotherton ..... 248/188.4
824,525 A * 6/1906 Bonney ..... 248/188.4
2,300,485 A * 11/1942 Bristow ..... 52/769
3,625,462 A 12/1971 Jordan
4,125,944 A * 11/1978 Esposito et al. ..... 33/347
4,439,961 A * 4/1984 Witte ..... 52/126.1
4,915,335 A 4/1990 Miles
5,141,076 A 8/1992 Joyce et al.
5,427,342 A 6/1995 Gagnon
5,725,188 A 3/1998 Monteiro, Jr.
5,749,555 A * 5/1998 Albrecht ..... 248/346.01
5,966,881 A * 10/1999 Kitagaki ..... 52/293.3
6,178,709 B1 * 1/2001 Hertz ..... 52/292
D600,875 S * 9/2009 Hermans ..... D34/38
8,347,571 B2 1/2013 Fehr et al.
8,833,020 B2 * 9/2014 Oliver et al. ..... 52/292
2003/0033773 A1 * 2/2003 Houpapa et al. ..... 52/299
2009/0151282 A1 * 6/2009 Loayza ..... 52/261
2014/0007529 A1 * 1/2014 Alvarez Moysen ..... 52/220.2

FOREIGN PATENT DOCUMENTS

JP 06316940 A * 11/1994 ..... E02D 27/01

* cited by examiner

*Primary Examiner* — Brent W Herring
(74) *Attorney, Agent, or Firm* — K. P. Glynn; D. M. Meagher

(57) ABSTRACT

A universal leveling device for outdoor structures of wood and other vulnerable materials for leveling, stabilizing and protecting against ground hazards, has at least a first and a second flat groove on its top, at right angle to each other, and on its bottom has first and second vee grooves each with two opposing angled walls. The reversible device can accommodate vertical and tilted support structures.

18 Claims, 10 Drawing Sheets

FIGURE 10
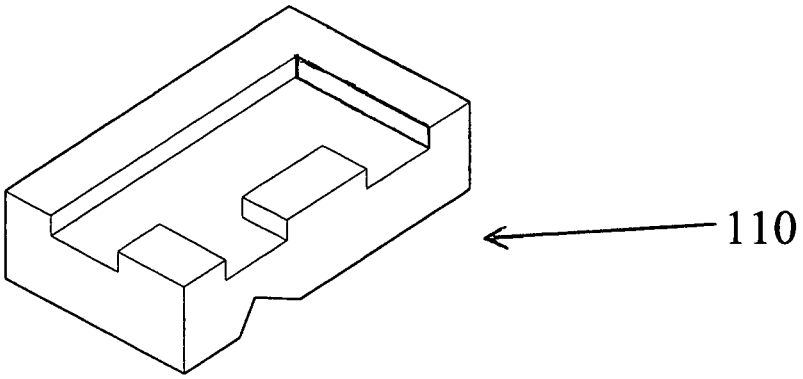
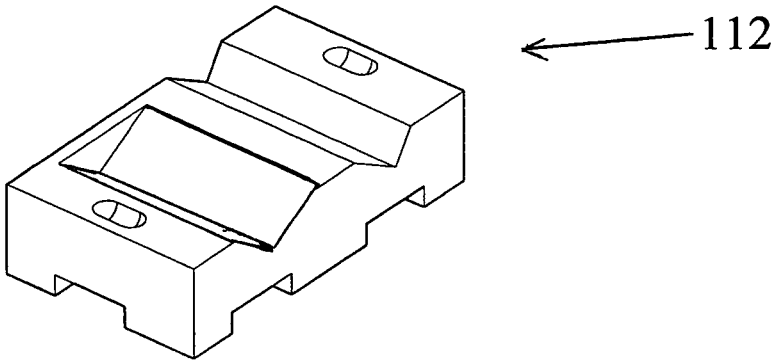
FIGURE 11

UNIVERSAL LEVELING DEVICE

REFERENCES TO RELATED APPLICATIONS AND PATENTS

The present invention claims priority, as it is a non-provisional application of a provisional patent application by the same inventors herein, filed on 28 Nov. 2012, and having a Ser. No. of 61/730,870, and titled "A Universal Leveling Device That Protects Against Ground Moisture, Weed Whacking And Has Stackable Capabilities".

BACKGROUND OF INVENTION a. Field of Invention

The invention relates generally to the field of stabilizing, anchoring and leveling outdoor free standing structures, such as swing sets, elevated forts, wooden slides, gazebos, sheds, picnic tables, benches and the like. The legs or support structures of these products are subject to and often victims of the ground below them. Exposure includes uneven or sloped ground, ground moisture, weed whacking and mowing damage, rot and other problems. The present invention is a unique reversible support pad that performs numerous functions simultaneously and both protect the outdoor structures and reduce accidents sometime otherwise cause by tilted structures.

b. Description of Related Art

The following patents are representative of the field pertaining to the present invention:

U.S. Pat. No. 8,347,571 B2 to Fehr et al describes a structural column assembly of the type used for erecting building structures and the like that is bedded in a concrete footing formed in situ in an earthen hole. The column assembly includes a post whose bottom end is suspended above a floor of the hole by a stilt. The stilt includes a plurality of legs which extend from the post's bottom end and grip the hole floor through a plurality of cleats. The cleats help stabilize the column assembly during the concrete pour operation so that it does not shift out of position. The stilt legs are provided with a base pad, which is set below the bottom end of the post at a predetermined distance so that the concrete footing can be poured in a single operation immediately after the hole is formed. The stilt can accommodate posts made from wood, pre-cast concrete or any other known construction material. The stilts can be manufactured from formed flat steel or commercially available angle iron and channel stock.

U.S. Pat. No. 5,725,188 to Monteiro, Jr. describes a lawn chair leveling block includes a portable rigid, flat ground-engaging pad designed to support the lawn chair in a level position on a sloped ground surface. The pad is provided with an upstanding elevation block having a deep groove along a top surface, and the groove is designed to cradle a U-shaped leg of the chair. Blind holes positioned in the pad at opposite ends of the elevation block are designed to support individual tubular, vertical chair legs. In addition to being utilized for leveling a lawn chair on a sloped surface, the block prevents a chair leg from sinking into soft soil so as to eliminate the risk of the chair tipping over.

U.S. Pat. No. 5,427,342 to Gagnon describes a support is provided for positioning on the base of a wooden lawn furniture leg. The support has an area that is at least five times the area of the bottom of the leg to distribute the load over a large area. This permits easy sliding of the leg across a lawn. The support is arranged to prevent prolonged contact of the leg with a source of moisture. In addition, the support provides venting to the bottom of the leg to minimize dry-rot.

U.S. Pat. No. 5,141,076 to Joyce et al. describes a device to be used on the legs of standard wooden folding stepladders to insure the stability of said ladders while being used on weak, non-compacted or slippery areas, into which a stepladder might tend to sink, or across which a stepladder might tend to slide. Said device consists of a semi-rigid pad that when attached to the bottom of any or all of the legs of any standard wooden folding stepladder will then increase the stepladder leg footprint area resulting in more stability of said stepladder. In addition, the high friction material of which the stepladder foot pad may be constructed will tend to prevent the stepladder legs from slipping across slippery surfaces.

U.S. Pat. No. 4,915,335 to Miles describes a stabilizer for a lawn chair, sand chair, chaise lounge, as well as other similar chairs, which, in a first embodiment, has an adapter that readily fits over the front and/or rear lower horizontal tubing of the chair-frame, which adapter is provided with right-angled end-corners directly and laterally adjacent the rounded, curved ends of the respective lower horizontal tubing, where such lower horizontal tubing curve upwardly in transition to join with an upwardly, angularly-extending upright tubing of the chair-frame, whereby such curved ends, about which lateral tipping over typically occurs, are negated. In a second embodiment, the stabilizer of the invention snap-fits onto a lower horizontal tubing of the chair-frame, with such stabilizer also having a length greater than the length of the lower horizontal tubing, the ends of which stabilizer are provided with generally triangular-shaped, flat projections. The stabilizer is readily rotatable about the lower horizontal tubing to which is attached, so that the end-projections may be oriented at any desired angle. Thus, the flat end-projections may be oriented so that they lie flat against the ground when the chair is used on firm ground or cement, or may be oriented 90 degrees therefrom so that the pointed apices or corners of each flat end-projection faces toward the ground, which is especially useful when using a chair on soft sand.

U.S. Pat. No. 4,439,961 to Witte describes a leveling and locating or positioning device is disclosed which includes a force-bearing structure which is guided for vertical leveling movement by a vertical reference device which also provides a horizontal position reference. Horizontal movement of a tapered wedge device, which operatively interfaces with a sloped floor member of the force-bearing structure, causes vertical movement of the force-bearing structure and the resulting leveling function. A horizontal extender device, slidably mounted to and supported by the force-bearing structure, provides the horizontal locating or positioning function. A support device is operatively included or mounted to one end of the horizontal extender device and is configured to operatively interface with the member or device which is to be leveled and located or positioned.

U.S. Pat. No. 3,625,462 to Jordan describes the present invention relates to furniture joints and ground-engaging i.e. foot, members of furniture associated with such joints. There is provided a joint in an article of furniture between two interengaging members, the joint having a first part with an H cross section elongated element and a second part including a pair of bosses spaced apart by a distance generally equal to the width of the H central web. These joint parts are a push fit together and are bonded by a heat-treated resin adhesive. A ground-engaging member associated with one part of the joint is so curved that in an unloaded state only the end regions of the curve engage the ground whereas in a loaded state not only the end regions but also at least some intermediate regions engage the ground. There is also provided an improved method of making a part of the joint disclosed.

Notwithstanding the prior art, the present invention is neither taught nor rendered obvious thereby.

SUMMARY OF INVENTION

The present invention is directed to a universal leveling device for outdoor structures of wood and other vulnerable materials for leveling, stabilizing and protecting against ground hazard. The device includes a pad, the pad having a top, a bottom and at least one side wall, the pad having a first flat groove on its top, and having a second flat groove on its top, the second flat groove being positioned at a right angle to the first flat groove, the bottom having a first vee groove with two opposing angled walls, being a first wall having an angle of about 70 degrees to about 35 degrees from horizontal and a second wall having an angle of about 55 degrees to about 20 degrees from horizon, and having a second groove with two opposing walls, being a first wall having an angle of about 60 degrees to about 45 degrees from horizontal and a second wall having and angle of about 45 degrees to about 30 degrees from horizon.

In some embodiments of the present invention universal leveling device, the two grooves on the top of the pad are parallel to one another.

In some embodiments of the present invention universal leveling device, the top of the pad has horizontally flat corners and wherein the bottom of the pad has horizontally flat corners.

In some embodiments of the present invention universal leveling device, the top includes three flat grooves.

In some embodiments of the present invention universal leveling device, two of the three flat grooves are parallel to one another.

In some embodiments of the present invention universal leveling device, at least one of the grooves on the top of the pads traverses less than the full width of the top of the pad and has at least one end wall.

In some embodiments of the present invention universal leveling device, at least one of the grooves has two end walls.

In some embodiments of the present invention universal leveling device, at least one of the grooves on the top of the pads traverses the full width of the top of the pad and has no end walls.

In some embodiments of the present invention universal leveling device, the pad has a top view selected from the group consisting of square, rectangle, circle, oval and polygon of at least five sides.

In some embodiments of the present invention universal leveling device, the pad is made of a moisture resistant material selected from the group consisting of plastic, rubber, recycled tires and combinations thereof.

In some embodiments of the present invention universal leveling device, there is at least one ground-anchoring mechanism. In some embodiments of the present invention universal leveling device, the ground-anchoring mechanism includes at least one orifice through the pad for receiving an anchor.

In some embodiments of the present invention universal leveling device, the anchor is included and is selected from the group consisting of a rod, a nail, a pin, a coil pin and a bolt.

In some embodiments of the present invention universal leveling device, the anchor includes at least one attachment mechanism for attachment to the outdoor structures and at least one elongated earth penetrating member for insertion through the at least one orifice.

In some embodiments of the present invention universal leveling device, the pad is stackable with identical other pads.

In some embodiments of the present invention universal leveling device, the pad further includes at least one stacking stabilizer. In some embodiments of the present invention universal leveling device, the pad has a plurality of stacking stabilizers on the top and a plurality of stacking stabilizers on the bottom. In some embodiments of the present invention universal leveling device, the plurality of stacking stabilizers are a combination of nesting protrusions and recesses.

In some embodiments of the present invention universal leveling device, there are a plurality of stacking stabilizer recesses on one of the pad top and the pad bottom, and plurality of complementary stacking stabilizer protrusions on the other of the pad top and the pad bottom.

In some embodiments of the present invention universal leveling device, there are four stacking stabilizer recesses on one of the pad top and the pad bottom, and four complementary stacking stabilizer protrusions on the other of the pad top and the pad bottom.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE SEVERAL VIEWS OF THE DRAWINGS(S)

The accompanying drawings, which are included to provide a further understanding of the invention and are incorporated in and constitute a part of this specification, illustrate preferred embodiments of the invention and together with the detail description serve to explain the principles of the invention. In the drawings:

FIG. 10 and FIG. 11 show variations of present invention universal leveling devices, with one end open and one end closed, of a flat groove and a vee groove, respectively; and, FIG. 12 shows a block diagram listing some of the preferred embodiment features of present invention universal leveling devices.

DETAILED DESCRIPTION OF THE EMBODIMENTS

Figure 1:
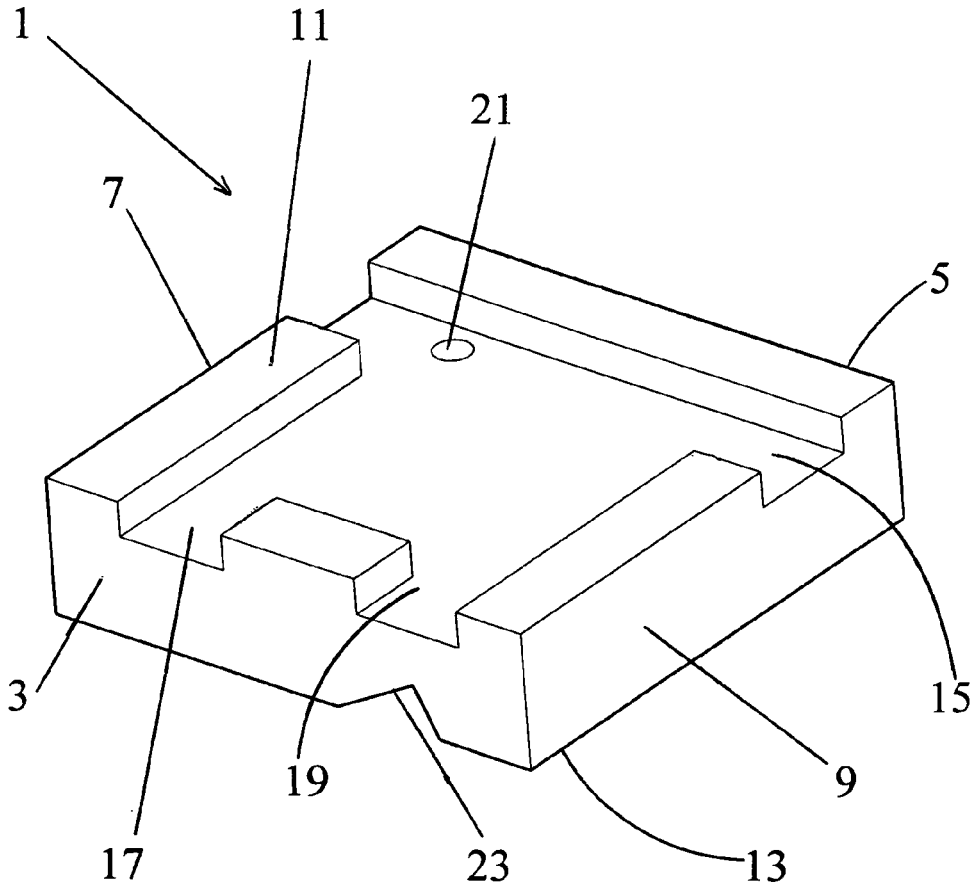
FIG. 1 is a perspective front view of one embodiment of the present invention universal leveling device showing multiple flat grooves on its top.

Referring now in detail to the drawings wherein like reference numerals designate corresponding parts throughout the several views, various embodiments of the present invention are shown.

FIG. 1 is a perspective front view of one embodiment of the present invention universal leveling device 1. It includes a front wall 3, a back wall 5, a left wall 7, a right wall 9, a top 11 and a bottom 13. Device 1 has an anchoring orifice 21 which may be used to insert an anchor member therethrough. Any anchoring device that may be hammered or otherwise forced into the ground may be used, but a rod such as a rebar with a welted large washer at one end is preferred. Such as anchoring device may be used to position and hold a present invention universal leveling device in place while a screw may be inserted into the washer into a wooden structure leg to help stabilize and maintain its position.

Top 11 of universal leveling device 1 has two parallel flat grooves 17 and 19 that intersect at right angles with flat grooves 15. Flat groove 15 has both ends open, but could alternatively have one end or both ends closed. These flat grooves are created to receive bottom ends of upright (vertical) legs or supports for such structures as elevated forts, slides and swing sets. Alternatively, they could be used to level or stabilize small unanchored structures such as sheds and gazebos. Also shown in FIG. 1 is a portion of vee groove 23 on bottom 13, which will be discussed in conjunction with FIGS. 3, 4 and 5, below.

Figure 2:
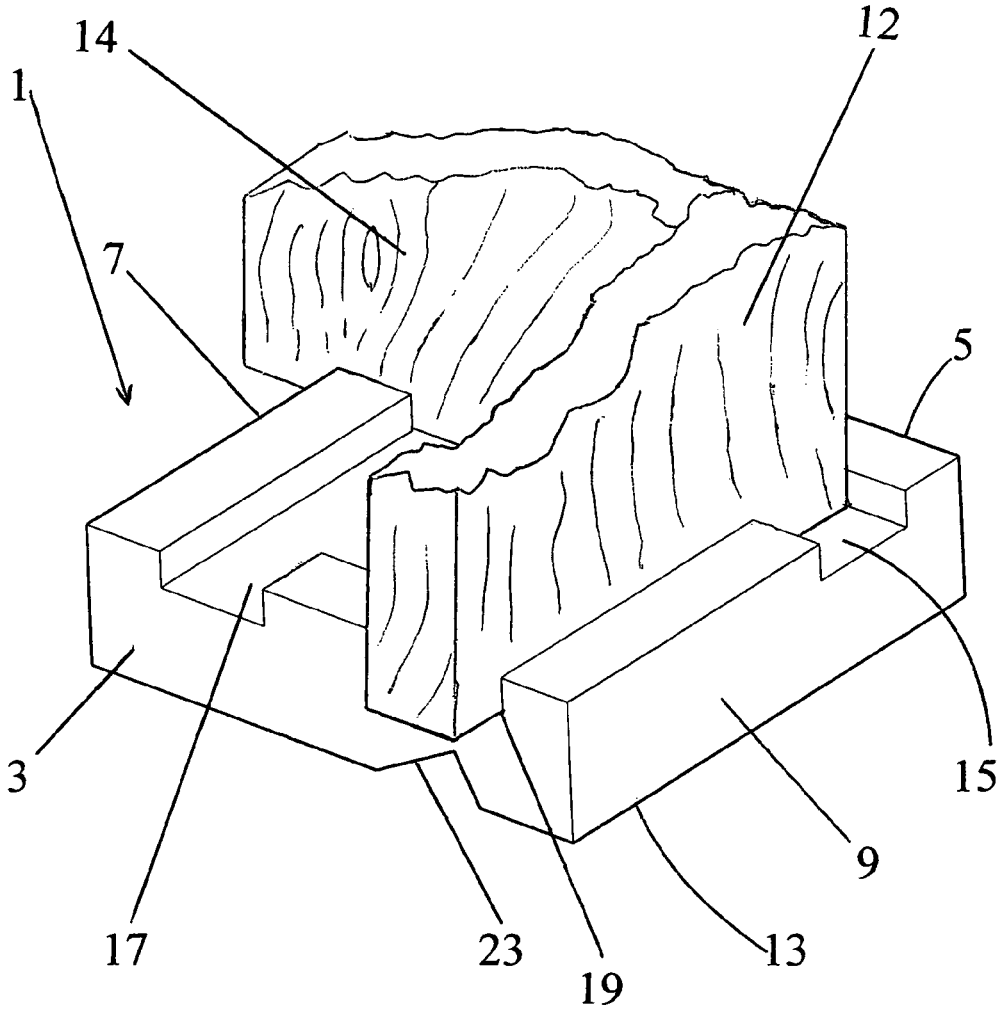
FIG. 2 shows the present invention leveling device of FIG. 1 with a right angled play fort leg contained therein.

FIG. 2 shows the present invention leveling device 1 of FIG. 1 with a right angled play fort leg contained therein. The leg includes a first upright 12 connected to a second upright 14. These uprights conveniently fit into flat grooves 15 and 19, as shown. The universal leveling device 1 performs a number of functions. First, it creates a level surface for an outdoor structure. Second, it may be used to elevate one or more corners of a structure to bring the entire structure into a vertical or horizontal position from a tilt. Third, it creates a moisture barrier between the ground and the outdoor structure. Forth, it protects the outdoor structure from weed whacker and lawnmower damage. Fifth, when stacked, the devices will eliminate a free moving corner on the downside of a hill or recess in the ground. Sixth, in some cases, they eliminate the need for and work involved in concrete bases or footings. In flat environments, one present invention device for each corner of a structure is ideal. If the structure needs leveling, it is preferred to use at least one device under each corner and additional stacked units where additional elevation is need.

Figure 3:
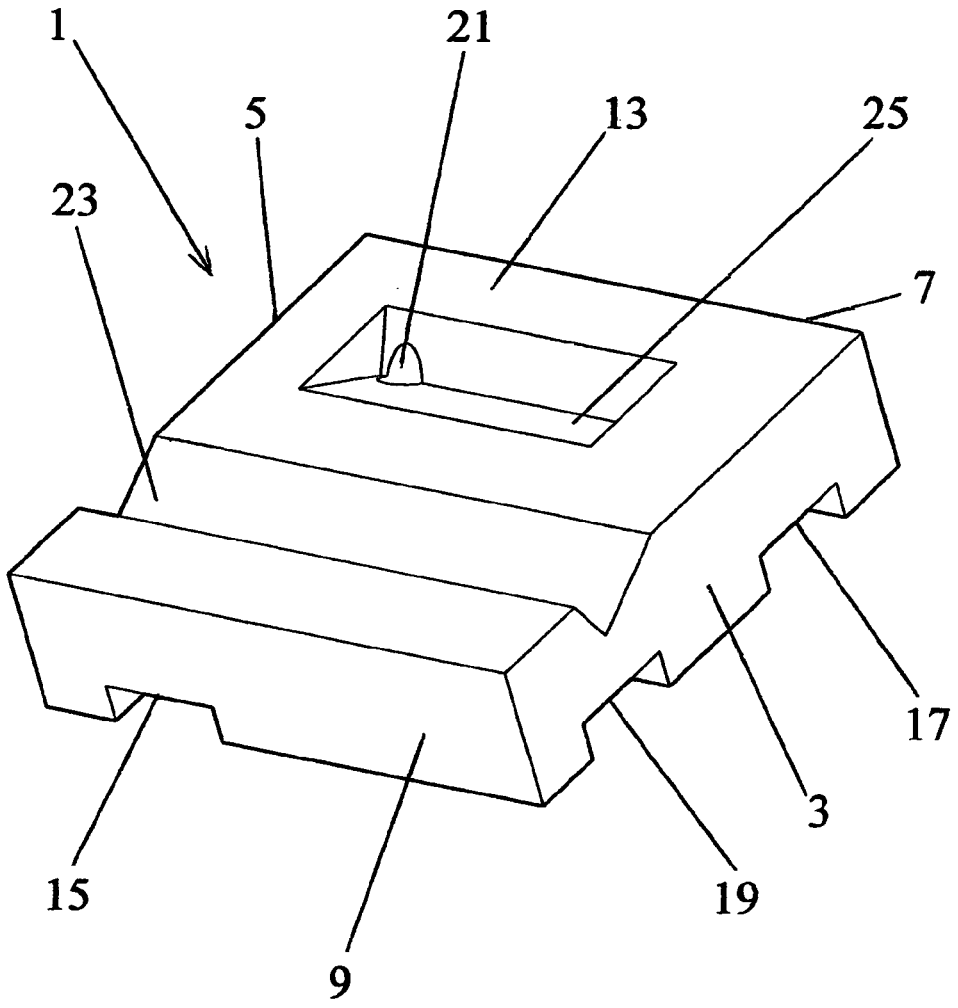
FIG. 3 shows the same present invention universal leveling device as shown in FIG. 1, but in a reverse position with its bottom facing up and revealing two vee grooves.
Figure 4:
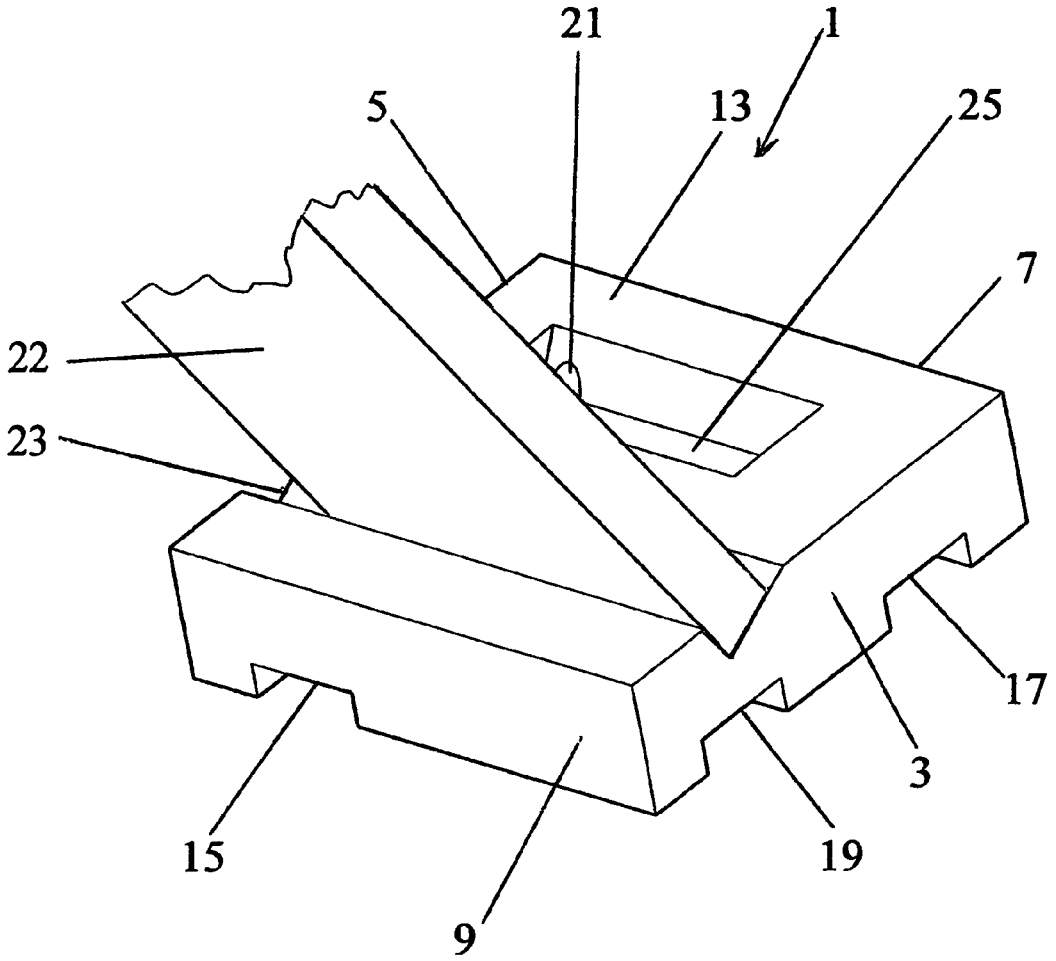
FIG. 4 shows the present invention universal leveling device of FIG. 3, but supporting a 45 degree angled support member of a swing set.
Figure 5:
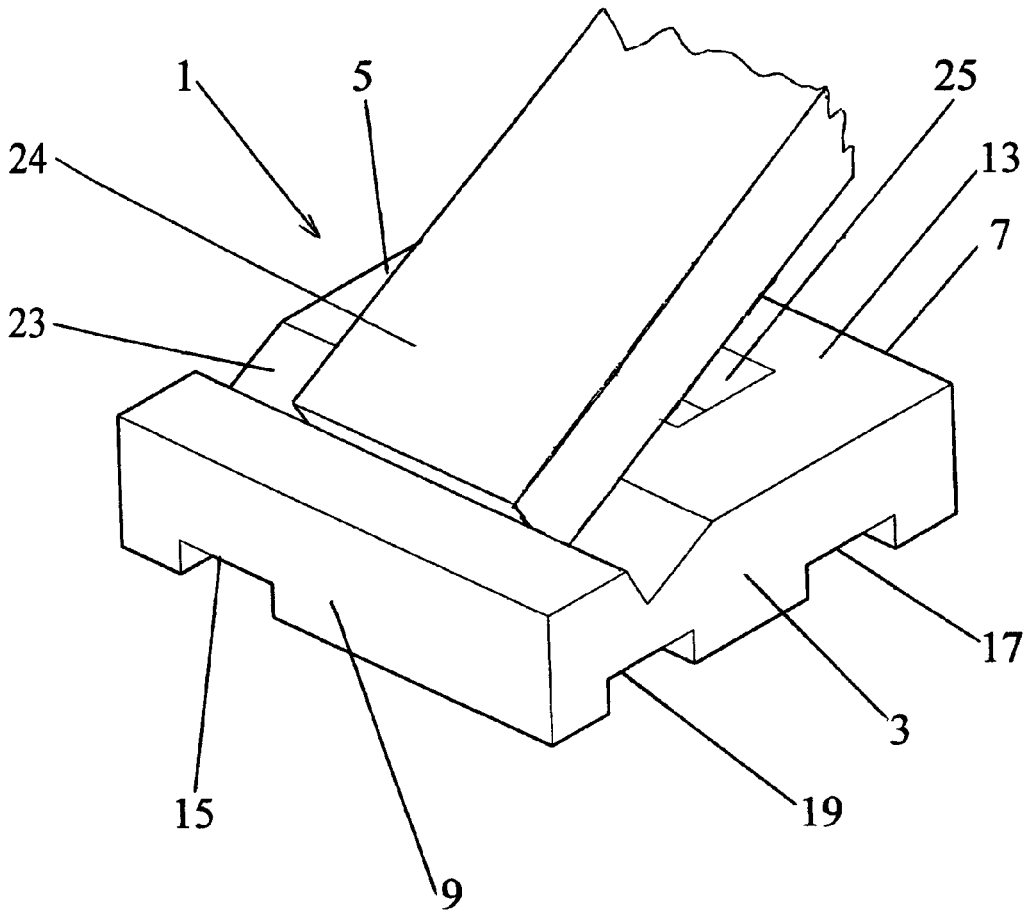
FIG. 5 shows the present invention universal leveling device of FIG. 3, but supporting a 60 degrees angled support member of a swing set.

FIG. 3 shows the same present invention universal leveling device 1 as shown in FIG. 1, but in a reverse position with its bottom 3 facing up and revealing two vee grooves. Vee groove 25 is closed at both ends and one side may have a 45 degree angle while its opposite side may have a 60 degree angle. It may range from 35 to 70 degrees. This vee groove 25 also includes anchoring orifice 21. A tilted 4 inch by 4 inch post support may be positioned in vee groove 25, an anchoring rod with washer may be passed through orifice 21 and hammered into the ground with the washer bolted, nailed or screwed onto the two by four support. Vee groove 23 is open on both ends and may be used for tilted linear supports. For example, FIG. 4 shows the present invention universal leveling device 1 of FIG. 3, but supporting a 45 degree angled support member 22 from a swing set. Another example is FIG. 5 which shows the present invention universal leveling device 1 of FIG. 3, but supporting a 60 degrees angled support member 24.

Figure 6:
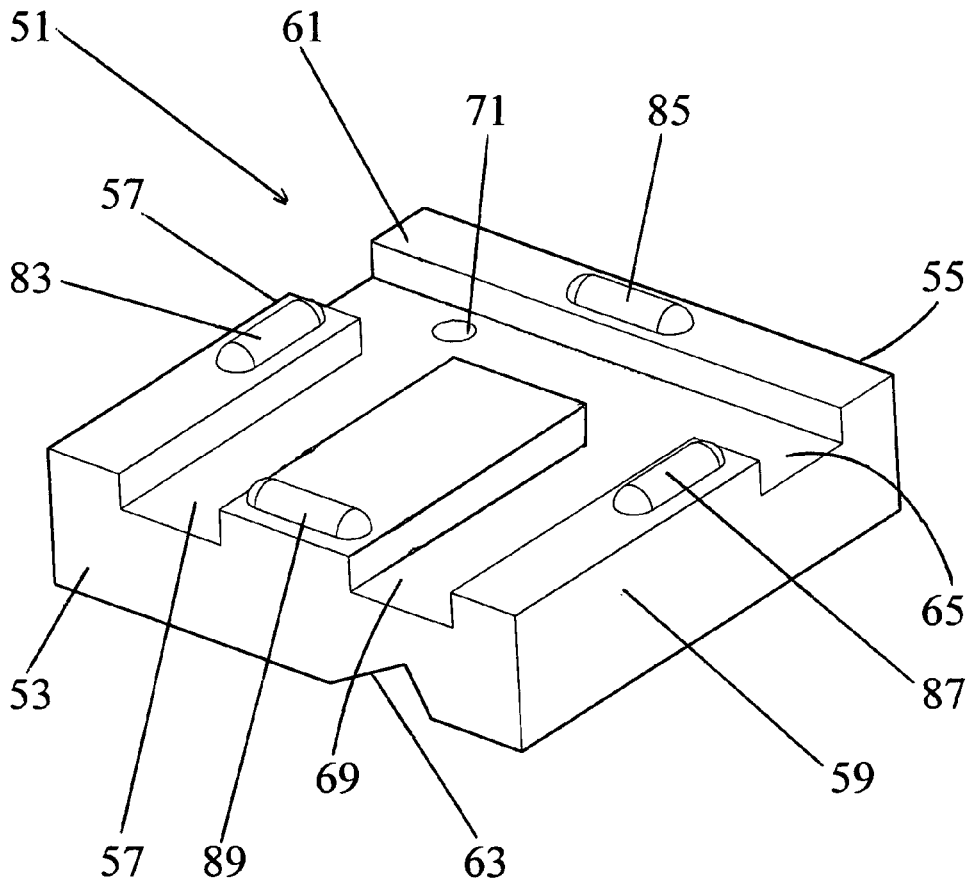
FIG. 6 shows an alternative present invention universal leveling device with multiple protruding stacking stabilizers.

FIG. 6 shows an alternative present invention universal leveling device 51 with multiple protruding stacking stabilizers 83, 85, 87 and 89. It includes a front wall 53, a back wall 55, a left wall 57, a right wall 59, a top 61 and a bottom 63. Device 51 has an anchoring orifice 71 which may be used similarly to orifice 21 described above in conjunction with the prior Figures. Top 61 of universal leveling device 51 has two parallel flat grooves 57 and 69 that intersect at right angles with flat groove 65. These flat grooves function in the same manner as those flat grooves described above. The protruding stacking stabilizers 83, 85, 87 and 89 are symmetric, as shown, so that stacking may occur with receiving recess stacking stabilizers with and of four orientations, i.e., the stacked devices need not have the grooves aligned. However, alignment is necessary where the orifice 71 is utilized on all stacked devices. (An anchor could pass through only the bottom orifice of a stack, but will preferably penetrate all devices in a stack.)

Figure 7:
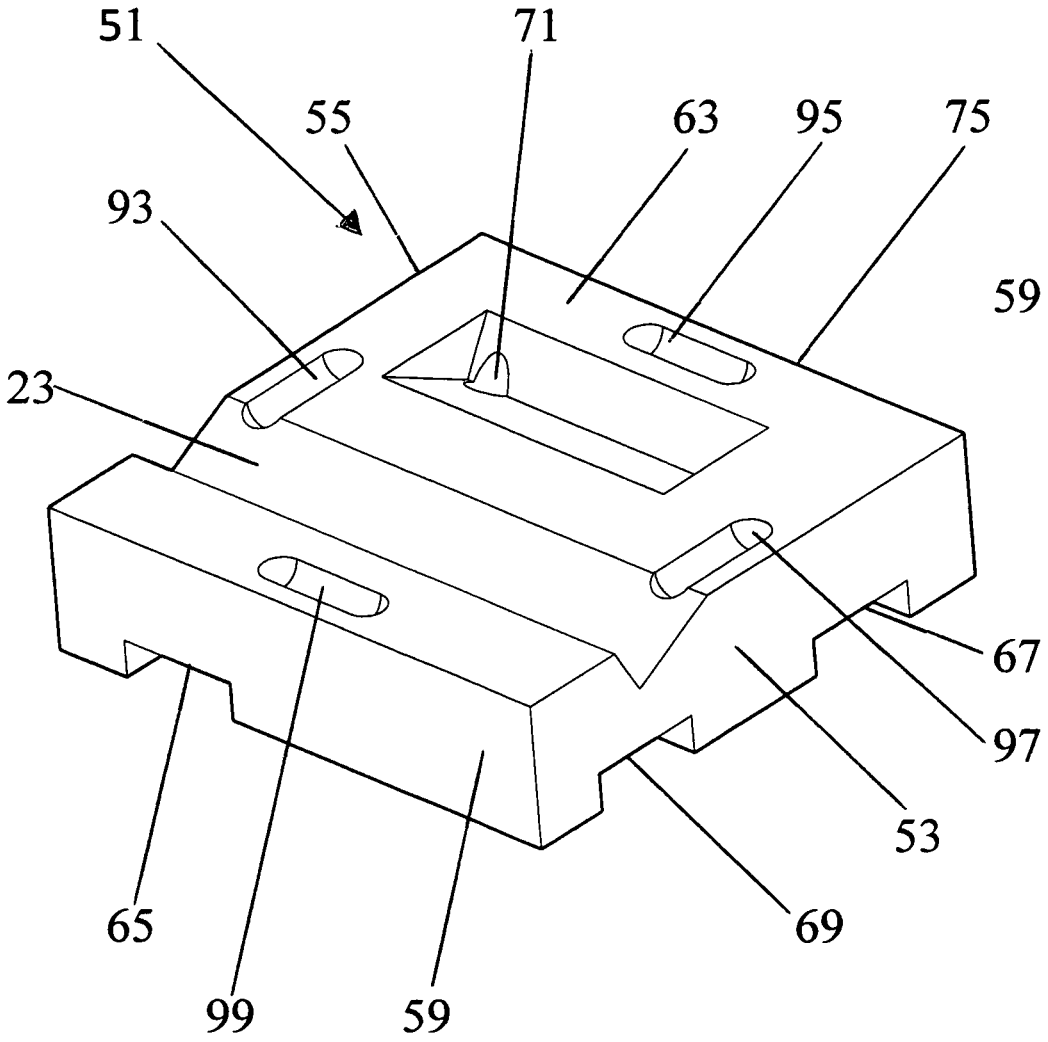
FIG. 7 shows the obverse of FIG. 6 with the present invention leveling device having recessed stacking stabilizers.

FIG. 7 shows the obverse of FIG. 6 with the present invention universal leveling device 51, revealing receiving, recessed stacking stabilizers 93, 95, 97 and 99, corresponding and position and size to protrusions 83, 85, 87 and 89 of FIG. 6, to create optimal stacking and nesting, as needed.

Figure 8:
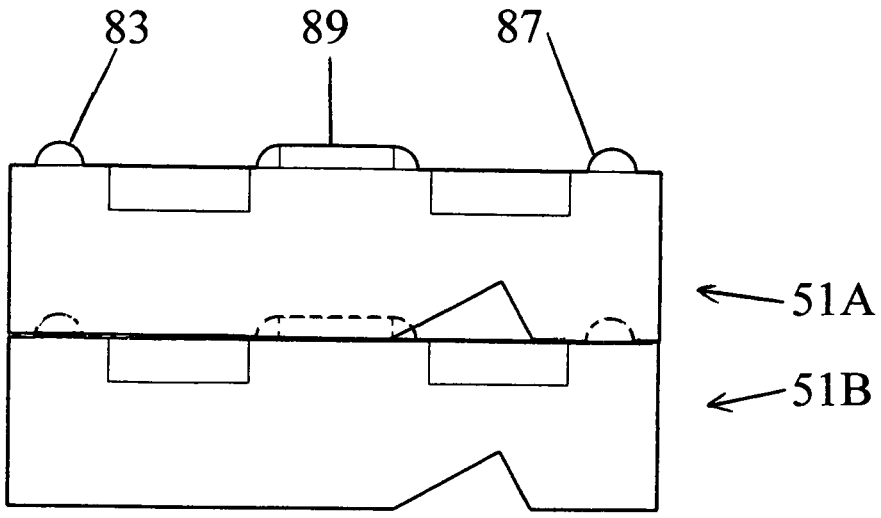
FIG. 8 shows two of the FIG. 6/FIG. 7 present invention universal leveling devices in a stacked position.

FIG. 8 shows two of the FIG. 6/FIG. 7 present invention universal leveling devices 51 in a stacked position, designated as devices 51A and 51B. as many devices may be stacked as needed, until stability becomes an issue, e.g., two, three or four may be used.

Figure 9:
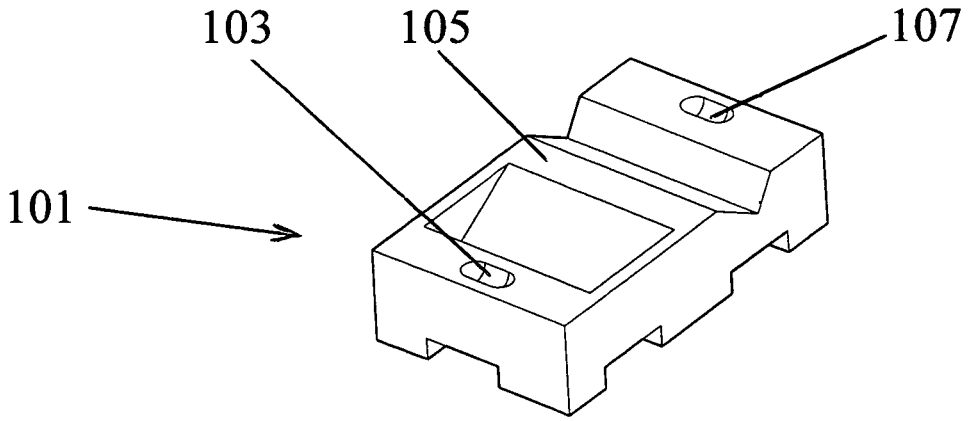
FIG. 9 shows a front perspective view of another present invention universal leveling device that has a rectangular shape.

FIG. 9 shows a front perspective view of another present invention universal leveling device 101 that has a rectangular shape, instead of a square shape. Any other shape may be used for a top view footprint without exceeding the scope of the present invention.

FIG. 10 and FIG. 11 show variations of present invention universal leveling devices 110 and 112, respectively, with one end open and one end closed, of a flat groove in FIG. 10 and a vee groove in FIG. 11, respectively.

Figure 12:
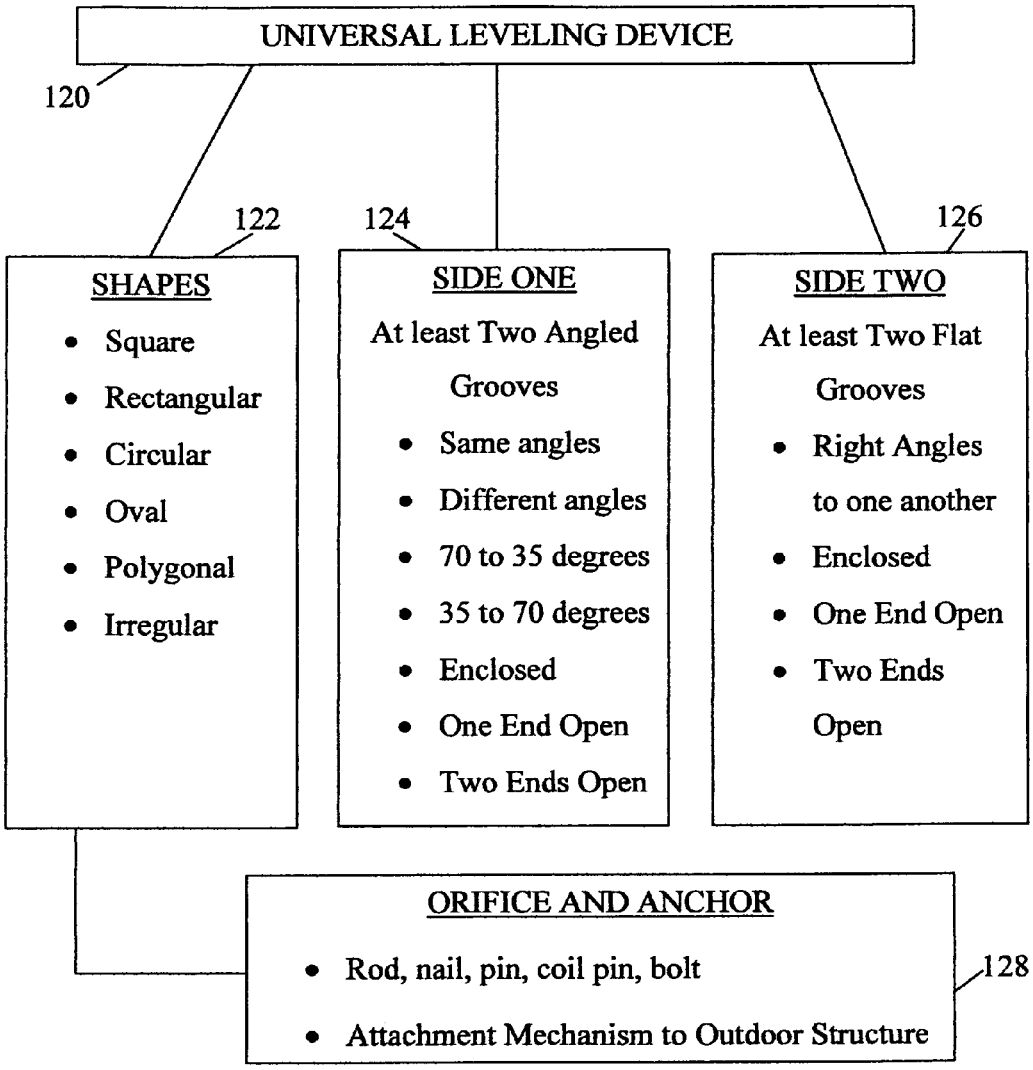

FIG. 12 shows a block diagram listing some of the preferred embodiment features of the present invention universal leveling device 120. These include block 122, listing some preferred shapes; block 124 describing angled (vee) grooves; block 126 describing flat grooves; and block 128 showing anchoring options.

The devices of the present invention are generally made of waterproof or water resistant materials, such as recycled rubber/tire chips melted and heat bound into the desired forms, rubber, recycled plastic, plastic, mixes of the foregoing, strong foams, such as micro-porous urethane, composite materials and other functional choices. Further, the present invention universal leveling devices may structurally be homogeneous or contain diverse materials. For example, they made have strengthening elements impeded therein, e.g., rigid foam with plastic or metal pieces, rods or plates. Further, although the exact overall shapes are not critical, the grooves should be designed for supported structure compatibility and the tops and bottoms should have flat corner areas, as shown, to enhance stacking capabilities.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A universal leveling device for outdoor structures of wood and other vulnerable materials for leveling, stabilizing and protecting against ground hazards, which comprises:

a pad, said pad having a top, a bottom and at least one side wall, said pad having at least two flat grooves on its top, including a first flat groove on its top, and having a second flat groove on its top, said second flat groove being positioned at a right angle to said first flat groove, said bottom having a first vee groove with two opposing angled intersecting walls, being a first wall having an angle of about 70 degrees to about 35 degrees to the plane of said bottom and a second wall having an angle of about 55 degrees to about 20 degrees to the plane of said bottom, and having a second vee groove with two opposing angled intersecting walls, being a first wall having an angle of about 60 degrees to about 45 degrees to the plane of said bottom and a second wall having and angle of about 45 degrees to about 30 degrees to the plane of said bottom.

2. The universal leveling device of claim 1 wherein said at least two flat grooves is three flat grooves wherein two flat grooves of said three flat grooves are parallel to one another.

3. The universal leveling device of claim 1 wherein said top of said pad has horizontally flat corners and wherein said bottom of said pad has horizontally flat corners.

4. The universal leveling device of claim 1 wherein said at least two flat grooves is three flat grooves.

5. The universal leveling device of claim 1 wherein at least one of said grooves on said bottom of said pad traverses less than the full width of said bottom of said pad and has at least one end wall.

6. The universal leveling device of claim 5 wherein said at least one of said grooves on said bottom of said pad has two end walls.

7. The universal leveling device of claim 1 wherein at least one of said grooves on said bottom of said pad traverses the full width of said top of said pad and has no end walls.

8. The universal leveling device of claim 1 wherein said pad has a top view peripheral shape selected from the group consisting of square, rectangle, circle, oval and polygon of at least five sides.

9. The universal leveling device of claim 1 wherein said pad is made of a moisture resistant material selected from the group consisting of plastic, rubber, recycled tires and combinations thereof.

10. The universal leveling device of claim 1 wherein there is at least one ground-anchoring mechanism.

11. The universal leveling device of claim 10 wherein said ground-anchoring mechanism includes at least one orifice through said pad for receiving an anchor.

12. The universal leveling device of claim 11 wherein said anchor is included and is selected from the group consisting of a rod, a nail, a pin, a coil pin and a bolt.

13. The universal leveling device of claim 12 wherein said anchor includes at least one attachment mechanism for attachment to said outdoor structures and at least one elongated earth penetrating member for insertion through said at least one orifice.

14. The universal leveling device of claim 1 wherein said pad is stackable with identical other pads.

15. The universal leveling device of claim 14 wherein said pad further includes at least one stacking stabilizer.

16. The universal leveling device of claim 1 wherein said pad has a plurality of stacking stabilizers on said top and a plurality of stacking stabilizers on said bottom, said plurality of stacking stabilizers being a combination of nesting protrusions and recesses.

17. The universal leveling device of claim 1 wherein there is a plurality of stacking stabilizer recesses on one of said pad top and said pad bottom, and plurality of complementary stacking stabilizer protrusions on the other of said pad top and said pad bottom.

18. The universal leveling device of claim 1 wherein there are four stacking stabilizer recesses on one of said pad top and said pad bottom, and four complementary stacking stabilizer protrusions on the other of said pad top and said pad bottom.

* * * * *